US005743388A

United States Patent [19]

Kerr et al.

[11] Patent Number: 5,743,388

[45] Date of Patent: Apr. 28, 1998

[54] FLEXIBLE AND SUBSTANTIALLY RECTANGULAR PACKAGE FOR CONTAINING MULTIPLE IRREGULAR SHAPED OBJECTS SUCH AS SOAP BARS

[75] Inventors: G. Scott Kerr, Mason; Gene M. Altonen, West Chester, both of Ohio

[73] Assignee: The Procter & Gamble Company, Cincinnati, Ohio

[21] Appl. No.: 682,865

[22] Filed: Jul. 2, 1996

Related U.S. Application Data

[63] Continuation-in-part of Ser. No. 556,866, Nov. 2, 1995, abandoned, which is a continuation of Ser. No. 126,460, Sep. 24, 1993, abandoned.

[51] Int. Cl.[6] ..... B65D 71/06

[52] U.S. Cl. ..... 206/77.1; 206/499; 206/506

[58] Field of Search ..... 206/77.1, 497, 206/499, 503, 506, 509

[56] References Cited

U.S. PATENT DOCUMENTS

| | | | |
|---|---|---|---|
| Re. 34,193 | 3/1993 | Carey | 383/43 |
| 1,487,014 | 3/1924 | Davis | 206/499 |
| 1,725,372 | 8/1929 | Richman . | |
| 2,037,439 | 5/1936 | Banks | 206/823 |
| 2,177,999 | 10/1939 | Schwantes | 206/77.1 |
| 2,356,110 | 8/1944 | Waters . | |
| 3,384,226 | 5/1968 | Crisci . | |
| 3,395,852 | 8/1968 | Koncak | 229/87 |
| 3,480,179 | 11/1969 | Rowland | 221/63 |
| 3,532,633 | 10/1970 | Withers | 252/90 |
| 3,719,318 | 3/1973 | Moran | 229/58 |
| 3,730,421 | 5/1973 | Stanley | 229/66 R |
| 3,817,018 | 6/1974 | Vickers | 53/32 |
| 4,210,249 | 7/1980 | Holmes . | |
| 4,793,490 | 12/1988 | Evert | 206/497 |
| 5,033,613 | 7/1991 | Liggett . | |
| 5,048,687 | 9/1991 | Suzuki et al. | 206/499 X |
| 5,098,012 | 3/1992 | Will | 229/87.01 |
| 5,310,052 | 5/1994 | Bindman | 206/497 X |

FOREIGN PATENT DOCUMENTS

| | | |
|---|---|---|
| 4037018 | 5/1992 | Germany . |
| 1560631 | 2/1980 | United Kingdom . |
| 2124597 | 2/1984 | United Kingdom . |

*Primary Examiner*—Jacob K. Ackun
*Attorney, Agent, or Firm*—Michael J. D'Amelio

[57] ABSTRACT

A flexible and substantially non-resilient package containing a number of three-dimensional objects. The package is such that multiple packages can be stacked on top of one another. The package includes a flexible container comprising opposing top and bottom walls and at least one side wall, all of which are joined together to form an interior chamber for containing the non-rectangular objects. The package further includes a balance component integral with the top and bottom walls to stabilize the package and keep it from tipping over. The three-dimensional objects to be contained, such as soap bars, are substantially rigid and non-rectangular. The objects have two non-planar opposing oblong faces. The faces are connected by a pair of opposing major peripheral edges and a pair of opposing minor peripheral edges, with the minor peripheral edges being smaller than the major peripheral edges. The objects are placed within the container in face to face relation with the major and minor peripheral edges of each object being parallel. The objects are constrained within the package so that movement of the objects with respect to one another and with respect to the container is substantially limited. Thereafter, multiple packages can be stacked on top of one another with the objects resting on their minor peripheral edges and the load of the objects can be transmitted through columns of stacked objects, with the balance component providing a stable base for the stacked packages.

18 Claims, 4 Drawing Sheets

FLEXIBLE AND SUBSTANTIALLY RECTANGULAR PACKAGE FOR CONTAINING MULTIPLE IRREGULAR SHAPED OBJECTS SUCH AS SOAP BARS

This is a continuation-in-part of application Ser. No. 08/556,866 filed on Nov. 2, 1995, now abandoned, which is a continuation of application Ser. No. 08/126,460 filed on Sept. 24, 1993, now abandoned.

FIELD OF THE INVENTION

The present invention relates to packages for containing multiple three dimensional, irregular shaped objects. The present invention has further relation to the packaging of multiple bars of soap in those packages. The present invention has further relation to the packaging of multiple bars of soap where the bars are irregular/non-rectangular shaped. The present invention has even further relation to such packages which can be stacked in a stable fashion on a store shelf or the like and can be stacked on top of one another in a warehouse with the objects substantially carrying the load of the stacked packages.

BACKGROUND OF THE INVENTION

In the past, bars of soap were typically sold individually by being packed in boxes, wrappers or the like. Recently, however, with the rise in popularity of club stores and the like, consumers have preferred to buy multiple bars of soap at once. Therefore, in order to market multiple bars of soap, manufacturers have typically packaged individual bars of soap in flexible paper-based wrappers having semi-rigid paperboard inserts. Thereafter, a number of these wrapped individual bars of soap would then be taped together. Other manufacturers have packaged individual bars of soap in their own box and then wrapped a number of these individual boxes together with thermoplastic film, tape or the like. However, this type of packaging was very wasteful in that each individual bar needed its own box or wrapper and on top of that the bundle itself needed additional packaging, such as wrappings, tape or the like in order to be sold as a single unit. Furthermore, this type of packaging was deemed to be consumer unfriendly in that consumers will typically get the next bar of soap while they are taking a shower. It was found very inconvenient to get out of the shower, undue the thermoplastic wrap, then undo the individual box or wrapper and retrieve a bar of soap.

Some manufacturers have attempted to solve the problems of the prior art packages by shrink-wrapping a number of bars together. However, there are many reasons why shrink wrapping or like methods have not been an effective solution. It has been determined that when purchasing a bar soap consumers tend to prefer non-rectangular, or pillow-shaped bars of soap. In fact, many of the consumer preferred bars have become very irregularly shaped and have not had adequate surface area on their small ends in to stand on a shelf or the like. These irregular shaped bars have made it impractical to shrink wrap multiple bars together for sale as a single unit because they will not sit properly on a store shelf. For advertising purposes, store shelf space considerations, stacking stability and manufacturing criteria it is preferred that multiple bars of soap be packaged in face to face relation with the stack resting on the smaller side edges of the soap bars. Shrink wrapped bars cannot stand on a store shelf or the like, or be stackable on top of one another, in a stable fashion when placed in this orientation. The irregular shape of the bar causes the unit of multiple bars to become unstable when resting on the small ends of the bars and the package tends to tip over.

While at first glance it may seem desirable to place a number of soap bars in a single paperboard box, this solution has many disadvantages. Manufacturers have had trouble sealing the corners of rectangular boxes in order to provide sufficient barrier to protect the soap bars from moisture and perfume loss during shipping and storage. Furthermore, it is desirable to provide a package whose size can be reduced after a soap bar is removed. This is so the package will not take up extra space in a consumer's cabinet.

With the advent of the consumer preference for these irregular shaped bars, most all manufacturers continue to package individual bars of soap in their own individual box and then wrap a number of these together to sell as a single unit, as described above. As was stated above, this is a very expensive way to market and sell multiple bars of soap and is also consumer unfriendly. Moreover, many manufacturers place the groups of multiple bars of soap in shipping containers for storing and shipping the soap. The shipping containers are usually designed to carry a load of multiple stacked shipping containers. This is a disadvantage in that the soap bars are strong enough to carry the load, and the use of shipping containers merely adds to the final cost of the product. However, due to the configuration of the irregularly shaped bars, shipping containers are needed to carry the load because the units of multiple bars cannot be stacked in such a way so as to allow the soap bars to carry the load.

There has therefore been a need for a package for containing multiple irregular shaped objects such as soap bars which is easy to use for consumers, is stackable on a store shelf in a desired orientation, substantially reduces the amount of materials being used to package the soap and is able to be stacked on top of one another.

It is therefore an object of the present invention to provide a single package for containing multiple irregular shaped three-dimensional objects, such as soap bars, which can be stacked on a store shelf or the like and sold as a single unit.

It is another object of the present invention to provide such a package wherein multiple packages can be stacked on top of one another and wherein the load can be transferred through a column of individual three-dimensional objects.

It is another object of the present invention to provide such a package which significantly reduces the amount of material needed to package multiple bars of soap.

It is another object of the present invention to provide such a package which easy for consumers to open, retrieve a bar of soap, and reclose.

It is yet another object of the present invention to provide such a package which is able to reduce its size after the removal of an object.

The aforementioned and other objects of the invention will become more apparent hereinafter.

SUMMARY OF THE INVENTION

In accordance with the present invention there is provided a flexible and substantially non-resilient package containing a plurality of three-dimensional objects. The package is such that multiple packages can be stacked on top of one another. The package includes a flexible container comprising opposing top and bottom walls and at least one side wall, all of which are joined together to form an interior chamber for containing the non-rectangular objects. A balance component for providing the package containing the non-rectangular objects with stability is also included. This balance component may comprise a lip that is preferably disposed on the exterior perimeter of the top and bottom walls thereby forming a gusseted trough between the lip and the top and bottom walls. The three-dimensional objects to be contained, such as soap bars, are substantially rigid and non-rectangular. The objects comprise two non-planar substantially oblong faces. The faces are connected by a pair of opposing major peripheral edges and a pair of opposing minor peripheral edges, wherein the minor peripheral edges are smaller than the major peripheral edges. The objects are placed within the container in face to face relation with the major peripheral edges and the minor peripheral edges of each object being substantially parallel. The objects are substantially tightly constrained within the package so that movement of the objects with respect to one another and with respect to the container is substantially limited. Thereafter, multiple packages can be stacked on top of one another with the objects resting on their minor peripheral edges and the load of the objects can be transmitted through columns of stacked objects within the package.

BRIEF DESCRIPTION OF THE DRAWINGS

While the specification concludes with claims particularly pointing out and distinctly claiming the subject invention, it is believed that the same will be understood from the following description taken in conjunction with the accompanying drawings in which:

DETAILED DESCRIPTION OF THE INVENTION

Figure 1:
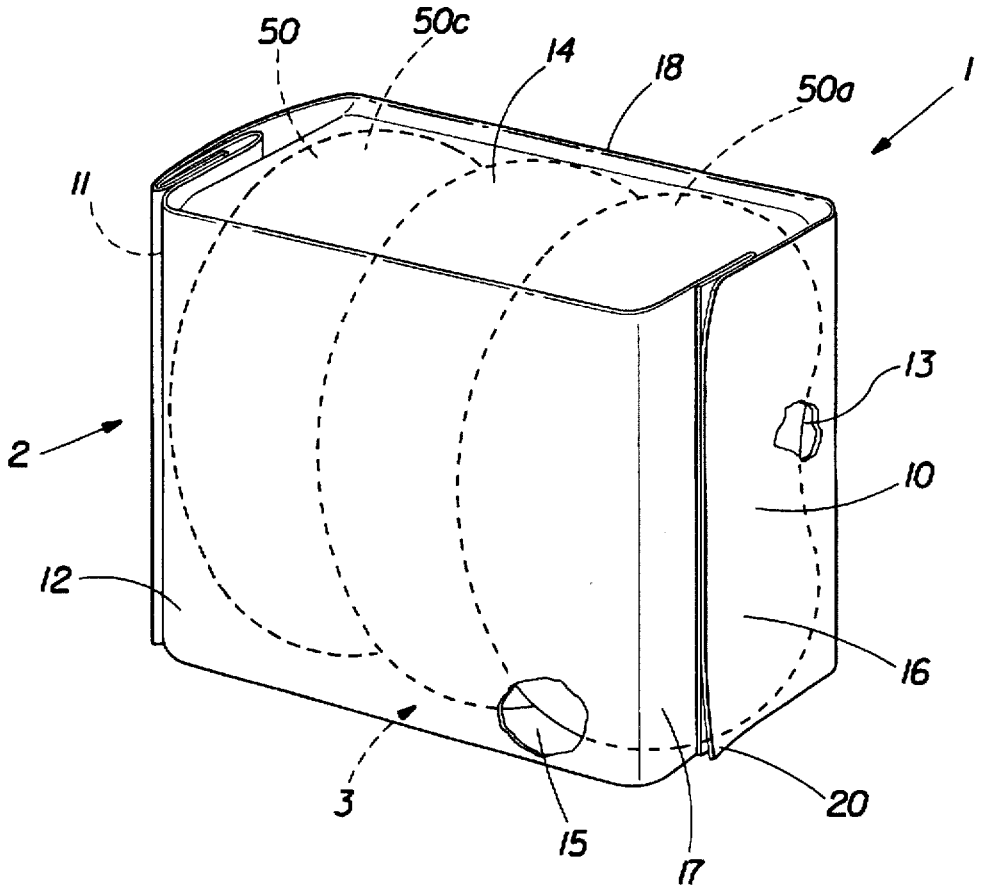
FIG. 1 is a perspective view of a package in accordance with the present invention, showing the contents within.
Figure 2:
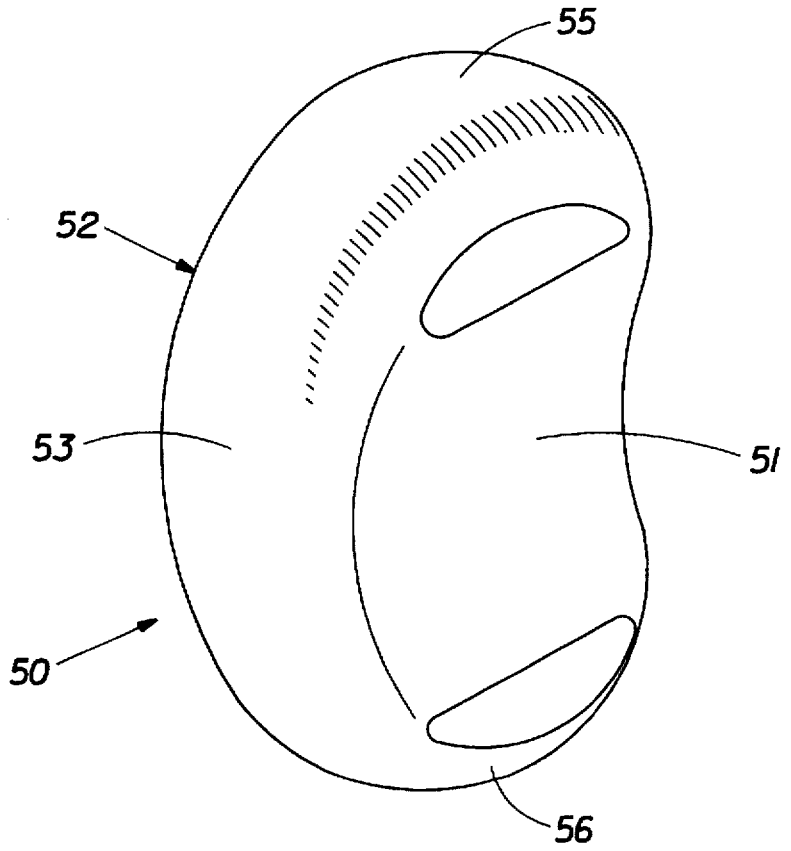
FIG. 2 is a perspective view of an irregular, non-rectangular three dimensional object of the type that is to be placed in the package of FIG. 1.

Referring now to the drawings wherein like numerals indicate the same element throughout the views, there is shown in FIG. 1 a perspective view of a package 1, in accordance with the present invention, for containing irregular shaped, non-rectangular three-dimensional objects 50 such as soap bars. As used herein a three-dimensional irregular shaped, non-rectangular object will be defined as an object having two substantially opposing, non-planar oblong faces connected by a pair of opposing major peripheral edges and a pair of opposing minor peripheral edges, wherein the major peripheral edges are longer than the opposing minor peripheral edges. The word "oblong" as used herein, is used as it is defined in the *Websters Third New International Dictionary*: "deviating from a square or circular form through elongation". An example of an object that the package of the present invention is designed to contain is given in FIG. 2. FIG. 2 is a perspective view of what is referred to in the art as a "pillow shaped" soap bar 50. Soap bar 50 has two substantially opposing non-planar faces 51 and 52. Faces 51 and 52 are connected by a pair of substantially opposing major peripheral edges 53 and 54 (not shown), and a pair of substantially opposing minor peripheral edges 55 and 56.

The package 1, in accordance with the present invention, can best be described by referring back to FIG. 1. Package 1 preferably includes a substantially rectangular container section 2 made from a flexible and substantially non-resilient material. Container 2 has opposing top and bottom walls 14 and 15, and two pairs of opposing side walls 10 and 11, 12 and 13. All of the walls are joined together to form an interior chamber 3 for containing a number of irregular shaped objects 50. The container 2 also includes a lip 18 preferably formed by the apex of a fold in the flexible and substantially non-resilient material, thereby forming a gusseted trough between the lip 18 and top and bottom walls 14 and 15. The lip 18 extends along the exterior perimeter of the top and bottom walls 14 and 15, and acts as a balance component to keep the container 2 stable. Preferably, the lip 18 extends substantially around the entire perimeter of the top and bottom walls 14 and 15 without interruption. It is intended to be understood, however, that the present invention also clearly contemplates alternative locations of the lip 18 on the top and bottom walls, other than the perimeter edge.

Suitable materials for forming container 2 include paper and polymer laminates, paper and polymer co-extruded materials, paper with paraffin/hot melt coatings and any other suitable material known in the art. Preferably, the material has enough memory to form a container which is substantially rectangular and can hold the rectangular shape indefinitely. That is, the material preferably has the ability to be folded or scored so that the package has the ability to maintain its substantially rectangular shape independent of the contents inside. However, a more flexible material, without sufficient memory could be used if paperboard inserts or the like were inserted into the container along one or both of the pairs of opposing side walls, thereby giving the container its substantially rectangular shape. Small, permanent paperboard inserts could be inserted along the perimeter of the top and bottom walls to effectuate the lip. Upon opening the consumer could discard the inserts so as to make the package collapsible. The small, permanent inserts would remain in the package thereby allowing for the balance feature of the container once the larger paperboard inserts are removed. Moreover, it is preferred that the flexible material have the necessary barrier properties in order to protect its contents. For bar soap the material needs sufficient air and moisture barrier to prevent fragrance and moisture loss before opening.

In a preferred embodiment the package further includes a reclosure device so that the container can be securely reclosed each time after it has been opened. FIG. 1 shows the reclosure device as a sealable edge 20 extending from closure flap 16 which forms part of the side wall 10. Sealable edge 20 has a low strength adhesive on its inner face which make contact with the container. After the package has been opened, by separating closure flaps 16 and 17, a consumer can gain access to the interior chamber 3 and retrieve a bar of soap 50. Thereafter, the side wall of the container 10 can be rolled or folded down to the next available bar in such a way that closure flap 16 covers the folded down portion of side wall 10 so that the sealable edge 20 can be resecured to the side wall 10, thereby reclosing the package. As will be appreciated by those skilled in the art, any number of reclosure devices can be used such as twist ties, tin ties, mechanical closures such as Velcro® tape, resealable adhesives, resealable tapes, self adhering co-adhesives and the like. Alternatively, the container 2 can be made from a material having sufficient dead fold properties that the package can be reclosed, after removal of an object, by folding the container.

The objects 50 are placed within the container in face-to-face relation, with the faces of the objects facing the opposing side walls 10 and 11 of container 2. That is, the peripheral edges of the objects are surrounded by the side walls and top and bottom walls. The objects 50 are packed within the container 2 in such a way that movement of the objects with respect to the container 2 and with respect to each other is substantially limited or prevented, i.e. the objects are tightly packed within the container. This allows the objects to be stacked on top of one another while substantially preventing an object from one package to enter the space between the objects of a package below it, thereby causing the stack to become unstable and possibly tearing the package material or falling over. That is, shingling is substantially prevented. The lip 18 on the bottom wall 15 acts to ensure the stability of the stacks of packages 1 by making the perimeter more rigid and stable.

Because the objects are irregularly shaped, the preferred maximum, but not required, distances between an object 50 and any side wall is given in terms of the distance taken perpendicular to the side wall at a point where the three dimensional object is closest to that side wall. For example the objects 50, shown in FIG. 1 are closest to side walls 12 and 13 at the midpoint of their major peripheral edges, between the minor peripheral edges. Similarly, objects 50 are closest to top and bottom walls 14 and 15 at the midpoint of their minor peripheral edges, between the major peripheral edges. Therefore, the preferred maximum distance between any object 50 and any given side wall, as described above, is less than ¼ in. (0.635 cm.). The preferred maximum distance between the object immediately adjacent the side wall 10 (object 50*a*) and the side wall 10 is defined in terms of the distance taken perpendicular to side wall 10 at a point where object 50*a* is closest to side wall 11. For the objects shown in FIG. 1, the point where 50*a* is closest to side wall 10 is at points closest to the minor peripheral edges. Similarly, the preferred maximum distance between the object immediately adjacent the side wall 11 (object 50*c*) and the side wall 11 is defined in terms of the distance taken perpendicular to side wall 11 at a point where object 50*c* is closest to side wall 11. For the objects shown in FIG. 1, the point where 50*c* is closest to side wall 10 is about at the center of the face adjacent the side wall. Therefore, the preferred maximum distance between objects 50*a* and 50*c* and the opposing side walls 10 and 11, respectively, as described above, is preferably less than ¼ in. (0.635 cm.). Therefore, if the objects were perfectly centered within the container the objects would have a maximum clearance between all of the walls of less than ⅛ of an inch. The maximum preferred distances between an object and a wall is taken when the object is abutting the opposing wall that the distance is being measured from. The maximum clearances given above are preferred but not required and are based on the balance between the clearance needed for insertion of the objects within the package and the clearance needed to give good stackability.

Figure 3:
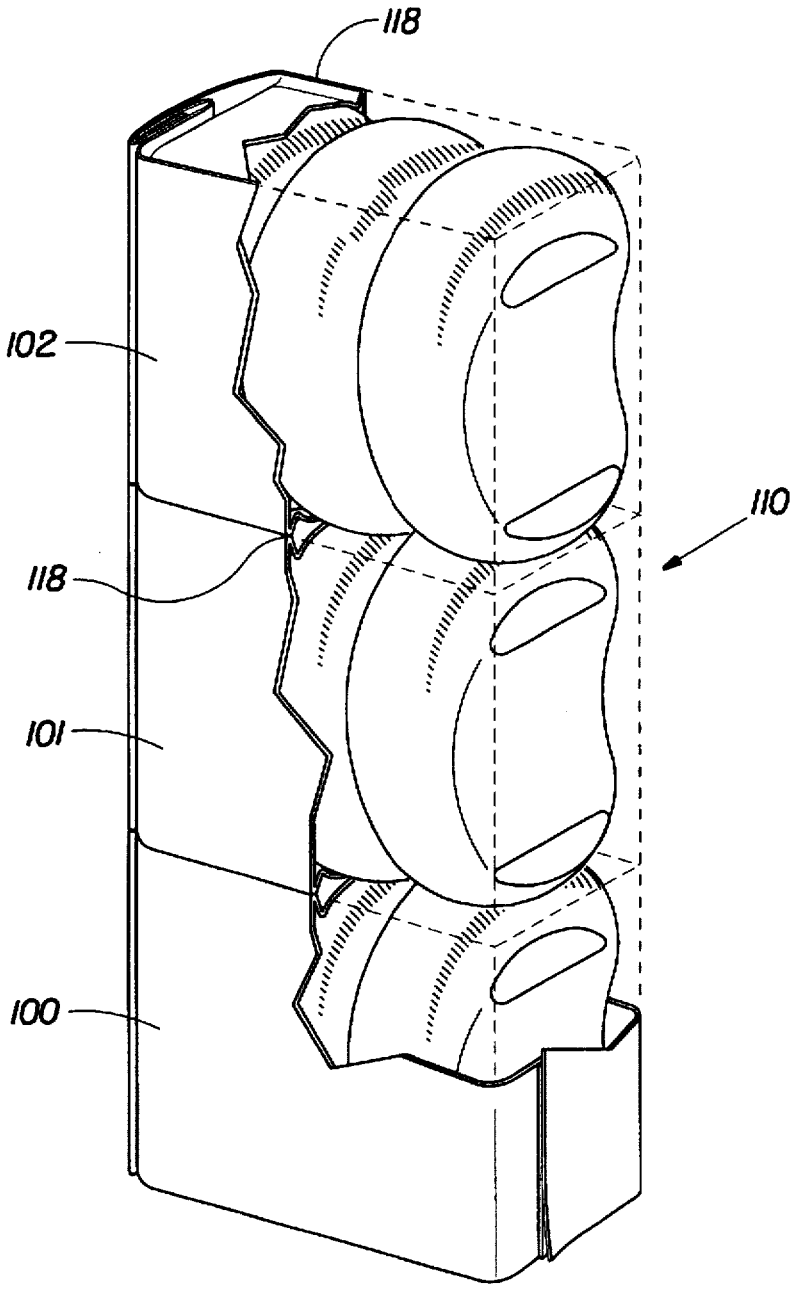
FIG. 3 is a perspective view of three packages, similar to the ones shown in FIG. 1, stacked on top of one another.

Because the objects are tightly packed within the container and because the package has a substantially rectangular shape that includes the lip extending around the exterior perimeter of the package, the package is able to stand on a store shelf or on top of one another with the objects resting on their minor peripheral edges. This is the preferred orientation for placing the packages on a shelf, so that shelf space is utilized efficiently and so that the package gives a good billboard effect with the advertising on side walls 12 and 13. Moreover, the placing of the objects 50 within the rectangular package 1 allows multiple packages to be stacked on top of one another in a warehouse or the like. This can best be described by referring to FIG. 3. FIG. 3 shows three packages 100, 101 and 102 stacked on top of one another. However, it is contemplated that many more packages could be stacked on top of each other. Because of the way the objects are packaged, the load or weight of the stacked packages is transmitted through a column 110 of objects 50. The tight fit of the bars within the package prevents shingling of adjacent bars, which could rip or tear the package. Allowing the bars to carry the load permits the objects to be shipped and stored in less expensive shipping containers, which do not have to carry the load, or no shipping container at all. The addition of the lip 118, provides a stable base for the package, thus preventing the stacks from tipping over when stacked on top of one another.

Figure 4:
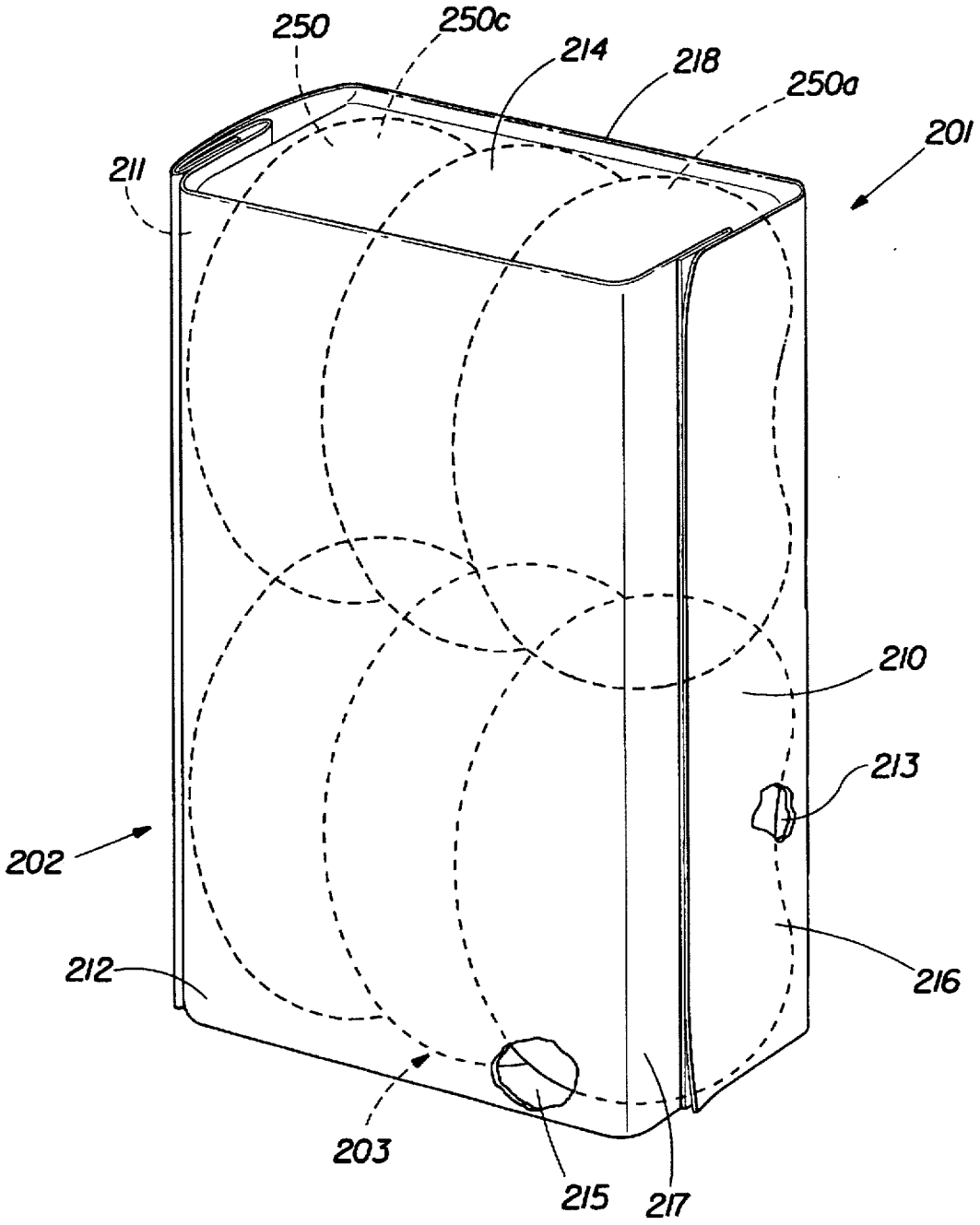
FIG. 4 is a perspective view of an alternative embodiment of a package in accordance with the present invention, showing the contents within.

An alternative embodiment of a package containing a plurality of three-dimensional objects in accordance with the present is shown in FIG. 4. FIG. 4 is a perspective view of a package 201, in accordance with the present invention, for containing irregular shaped, non-rectangular three-dimensional objects 250, identical to objects 50. Package 201 includes a substantially rectangular container section 202 made from a flexible and substantially non-resilient material. Container 202 has opposing top and bottom walls 214 and 215, and two pairs of opposing side walls 210 and 211, 212, and 213. Top and bottom walls 214 and 215 further include a lip 218 which preferably is formed by the apex of a fold in the material around the exterior perimeter edge of the top and bottom walls 214 and 215. All of the walls are joined together to form an interior chamber 203 for containing at least two stacks of irregular shaped objects 250. Each stack is such that the objects of each stack are placed in face-to-face relation with respect to each other, with the major peripheral edges and the minor peripheral edges of each object being substantially parallel. The faces of the objects are facing the opposing side walls 210 and 211; that is, the peripheral edges of the objects are surrounded by side walls 212 and 213, and top and bottom walls 214 and 215. The stacks are arranged such that the minor peripheral edges of the objects of one stack abut the minor peripheral edges of the objects of an adjacent stack so that the objects line up in columns. The objects 250 are packed within the container 202 in such a way that movement of the objects with respect to the container 202 and with respect to each other is substantially limited or prevented, i.e. the objects are tightly packed within the container.

The package can be formed in any number of ways known in the art including having the package material roll stock fed from a reel, wrapping it around a vertical mandrel, cutting and folding it to the proper shape and then filling it. It should be noted that the present invention requires one less operation and hence one less single operation machine. In the prior art manufacturing processes three operations were needed: one to form the boxes for containing individual soap bars, one to fill the boxes, and one to wrap multiple boxes together. In the present invention only two operations are needed: one to make the package and one to fill the package. Therefore, the present invention lends itself to a more efficient and inexpensive manufacturing method.

While particular embodiments of the present invention have been illustrated and described herein, various modifications may be apparent to those skilled in the art without departing from the spirit and scope of the present invention. Accordingly, the scope of the present invention should be considered in terms of the following claims and is understood not to be limited to the details described and shown in the specification and drawings.

What is claimed:

1. A flexible and substantially non-resilient package containing a plurality of three-dimensional objects, the package being such that multiple packages are stackable on top of one another, the package comprising:

(a) a container comprising opposing top and bottom walls and at least one side wall, the walls being joined together to form an interior chamber containing the three dimensional objects;

(b) a balance component integral to the top and bottom walls for providing stability of the package so that the package remains balanced and steady when containing the three-dimensional objects;

(c) the three-dimensional objects being substantially rigid and non-rectangular, and substantially in contact with each other; and (d) the objects being substantially constrained within the package so that movement of the objects with respect to one another and with respect to the container is substantially limited so that multiple packages can be stacked on top of one another whereby the load of the objects can be transmitted through columns of stacked objects.

2. The package according to claim 1 wherein the container further includes an integral reclosure device.

3. The package according to claim 2 wherein the integral reclosure device comprises a sealable edge extending from at least one side wall, the sealable edge having an adhesive disposed thereon for attaching the sealable edge to at least one side wall after the package is opened.

4. The package according to claim 1 wherein the container is made from a material having sufficient dead fold properties that the package can be reclosed through folding the container after removal of an object.

5. The package according to claim 1 wherein the container is made from a laminated paper material.

6. The package according to claim 1 wherein the three dimensional objects are soap bars.

7. The package according to claim 1 wherein the container is made from a flexible substantially non-resilient material having sufficient memory to maintain a substantially rectangular shape.

8. The package according to claim 1 wherein the balance component comprises at least one lip disposed upon the top and bottom walls.

9. The package according to claim 8 wherein the top and bottom walls have exterior perimeters, the at least one lip being disposed upon the exterior perimeters for providing stability for the package.

10. A flexible and substantially non-resilient package containing a plurality of three-dimensional objects, the package being such that multiple packages are stackable on top of one another, the package comprising:

(a) a container comprising opposing top and bottom walls, at least one side wall, all of the walls being joined together to form an interior chamber containing at least two stacks of the three-dimensional objects;

(b) a balance component integral with the top and bottom walls for providing stability of the package so that the package remains balanced and steady when containing the three-dimensional objects;

(c) the three-dimensional objects being substantially rigid and non-rectangular, and substantially in contact with one another; and (d) the objects being arranged within the container in contiguous contact to form at least two stacks of the objects, the objects being substantially tightly constrained within the package so that movement of the objects with respect to one another and with respect to the container is substantially limited so that multiple packages can be stacked on top of one another, whereby the load of the objects can be transmitted through columns of stacked objects.

11. The package according to claim 10 wherein the container further includes an integral reclosure device.

12. The package according to claim 11 wherein the integral reclosing device comprises a sealable edge extending from the side wall, the sealable edge having an adhesive disposed thereon for attaching the edge to a side wall after the package is opened.

13. The package according to claim 10 wherein the container is made from a material having sufficient dead fold properties that the package can be reclosed through folding the container after removal of an object.

14. The package according to claim 10 wherein the container is made from a laminated paper material.

15. The package according to claim 10 wherein the three dimensional objects are soap bars.

16. The package according to claim 10 wherein the container is made from a flexible substantially non-resilient material having sufficient memory to maintain a substantially rectangular shape.

17. The package according to claim 10 wherein the balance component comprises at least one lip disposed upon the top and bottom walls.

18. The package according to claim 17 wherein the top and bottom walls have exterior perimeters, the at least one lip being disposed upon said exterior perimeters for providing stability for said package.

* * * * *